US010179685B2

(12) United States Patent
Taylor et al.

(10) Patent No.: US 10,179,685 B2
(45) Date of Patent: Jan. 15, 2019

(54) PACKAGE CARRYING ARRANGEMENT

(71) Applicant: Process4, Inc., Chagrin Falls, OH (US)

(72) Inventors: Curtis Taylor, Chagrin Falls, OH (US); Matthew Hanson, Chagrin Falls, OH (US)

(73) Assignee: Process4, Inc., Chagrin Falls, OH (US)

( * ) Notice: Subject to any disclaimer, the term of this patent is extended or adjusted under 35 U.S.C. 154(b) by 124 days.

(21) Appl. No.: 15/081,439

(22) Filed: Mar. 25, 2016

(65) Prior Publication Data

US 2016/0280437 A1 Sep. 29, 2016

Related U.S. Application Data

(60) Provisional application No. 62/138,662, filed on Mar. 26, 2015, provisional application No. 62/149,822, filed on Apr. 20, 2015.

(51) Int. Cl.

| | |
|---|---|
| ***B65D 71/50*** | (2006.01) |
| ***B65B 15/00*** | (2006.01) |
| ***B65B 35/10*** | (2006.01) |
| ***B65D 71/44*** | (2006.01) |
| ***B65B 17/02*** | (2006.01) |
| ***B65D 21/02*** | (2006.01) |
| ***B65D 67/02*** | (2006.01) |

(52) U.S. Cl.

CPC ..... *B65D 71/50* (2013.01); *B65B 15/00* (2013.01); *B65B 17/025* (2013.01); *B65B 35/10* (2013.01); *B65D 21/0224* (2013.01); *B65D 67/02* (2013.01); *B65D 71/44* (2013.01); *B65D 71/502* (2013.01); *B65D 2571/0066* (2013.01); *B65D 2571/00283* (2013.01); *B65D 2571/00444* (2013.01); *B65D 2571/00456* (2013.01)

(58) Field of Classification Search

CPC ..... B65D 71/50; B65D 71/44; B65D 71/502; B65D 21/0224; B65D 67/02

USPC ..... 206/151, 145, 477, 159, 427

See application file for complete search history.

(56) References Cited

U.S. PATENT DOCUMENTS

| | | | | | |
|---|---|---|---|---|---|
| 3,199,908 | A * | 8/1965 | Poupitch | B65D 71/50 | 206/151 |
| 3,258,288 | A * | 6/1966 | Courter | B65D 71/50 | 206/151 |
| 3,331,500 | A * | 7/1967 | Poupitch | B65D 71/50 | 206/151 |
| 3,346,106 | A * | 10/1967 | Gooding | B65D 71/50 | 206/151 |
| 3,627,121 | A * | 12/1971 | Deasy | B65D 71/50 | 206/151 |
| 3,664,497 | A * | 5/1972 | Mascia | B65D 17/4012 | 206/151 |
| 3,669,258 | A * | 6/1972 | Mascia | B65D 17/165 | 206/151 |
| 4,111,298 | A * | 9/1978 | Mascia | B65D 71/50 | 206/151 |

(Continued)

*Primary Examiner* — Steven A. Reynolds

(74) *Attorney, Agent, or Firm* — Fay Sharpe LLP

(57) ABSTRACT

A portable package carrying arrangement adapted and configured to carry a plurality of containers which is particularly applicable for use with canned items and/or items packaged in a container. The portable package carrying arrangement includes a panel portion and a handle portion. The panel portion includes a plurality of container flanges configured to releasably secure a plurality of containers to the panel portion.

15 Claims, 10 Drawing Sheets

(56) References Cited

U.S. PATENT DOCUMENTS

| | | | | | |
|---|---|---|---|---|---|
| 5,285,892 | A * | 2/1994 | Adami | B65D 71/50 | 206/151 |
| 5,964,343 | A * | 10/1999 | Steiner | B65D 71/70 | 206/203 |
| 7,614,495 | B1 * | 11/2009 | Smithers | B65D 81/361 | 206/150 |
| 2006/0086063 | A1 * | 4/2006 | Magomedov | B65D 17/025 | 53/398 |
| 2008/0093243 | A1 * | 4/2008 | Smithers | B65D 71/50 | 206/427 |

* cited by examiner

PACKAGE CARRYING ARRANGEMENT

The present invention claims priority to U.S. Provisional Application Ser. No. 62/138,662, filed Mar. 26, 2015 and 62/149,822, filed Apr. 20, 2015, which are both fully incorporated herein.

The present invention relates to an arrangement to conveniently transport a plurality of food items, particularly to an arrangement to conveniently transport a plurality of packaged food items that are packaged in the same or similarly shaped, sized and configured packaging, more particularly to a portable package carrying arrangement that is configured to conveniently transport a plurality of packaged food items that are packaged in the same or similarly shaped, sized and configured packaging, and still more particularly to a portable package carrying arrangement that is configured to enable convenient loading, unloading and transporting of a plurality of packaged good items that are packaged in the same or similarly shaped, sized and configured packaging.

BACKGROUND OF THE INVENTION

Cans and/or containers are commonly used to store food and drink items for a variety of reasons including convenient production, convenient storage, and long-term storage due to a generally airtight seal. Non-limiting examples of foods packed in a can include pet food, canned soup, canned meat, etc. Such cans are often generally cylindrical in shape and traditionally manufactured from a durable material such as aluminum, tin, plastic or steel. Oftentimes, the canned goods are placed in a cart and/or basket by a consumer along with other items. As such, during the checking out and bagging of many items, similar types of can goods are commonly placed in separate bags, thus requiring resorting when the consumer unpacks the purchased items. Additionally, selecting and carrying large quantities of canned goods (e.g., canned cat food, etc.) can be inconvenient to a consumer.

It would be desirable to provide a lightweight package carrying arrangement that is capable of releasably securing one or more canned goods, which can maintain the cans together, and which can include a handle portion for the purpose of easily and conveniently carrying or transporting the package carrying arrangement.

SUMMARY OF THE INVENTION

The present invention is directed to a package carrying arrangement that can be used with food container items. In particular, the present invention is directed to an arrangement to conveniently transport a plurality of packaged food items that are packaged in the same or similarly shaped, sized and configured packaging. In one non-limiting arrangement, the present invention is directed to a portable package carrying arrangement that is configured to enable convenient loading, unloading, and transporting of a plurality of packaged food items that are packaged in the same or similarly shaped, sized and configured packaging. The package carrying arrangement is configured to releasably secure food container items. As can be appreciated, the package carrying arrangement can be used to releasably secure container items other than food container items.

In one non-limiting aspect of the present invention, the package carrying arrangement of the present invention is a carrying arrangement that can be easily and conveniently used by consumers to carry a plurality of containers. The package carrying arrangement is particularly applicable for use with canned items or items packaged in a container (e.g., canned pet food, canned soup, canned meat, canned seafood, canned fruit, canned vegetables, containers of mints/breath fresheners, containers of gum, containers of candy, beverage containers, spice containers, frozen beverage concentrate containers, containers of yogurt, containers of refrigerated or frozen bakery goods, containers of ice cream or sorbet, votive candles, etc.) and will be described with particular reference thereto.

In another and/or alternative non-limiting aspect of the present invention, there is provided a package carrying arrangement suitable for use in carrying containers of different sizes (e.g., two ounce containers, three ounce containers, five ounce containers, 5.5 ounce containers, eight ounce containers, thirteen ounce containers, sixteen ounce containers, twenty ounce containers, etc.). The package carrying arrangement of the present invention is particularly useful in carrying a plurality of container items (e.g., two containers, six containers, eight containers, twelve containers, sixteen containers, twenty containers, etc.). The package carrying arrangement as described in the present invention enables a user to load, releasably secure, and unload container items so as to easily and conveniently transport and/or carry said container items.

In yet another and/or alternative non-limiting aspect of the present invention, there is provided a package carrying arrangement that includes a body portion and a handle portion. The size, shape, material and/or colors of the components of the package carrying arrangement are non-limiting. Generally, the materials are durable, lightweight and liquid resistant; however, this is not required. Non-limiting materials that can be used include plastic, rubber, metal, resinous material, composite material, etc. In one non-limiting arrangement, the package carrying arrangement comprises components formed of a durable plastic material. The material used to form the package carrying arrangement can be clear, semi-clear or opaque. The package carrying arrangement can be manufactured by a variety of processes (e.g., molded, blow molded, extruded, stamped, formed by 3D printing, etc.). In one non-limiting specific embodiment, about 51-100% (and all values and ranges therebeween) of the package carrying arrangement is made of plastic material. In a specific configuration, the package carrying arrangement is partially or fully formed of polypropylene. However, it can be appreciated that the package carrying arrangement can be formed of other or additional materials (e.g., a high-density polyethylene (HDPE) plastic, a low-density polyethylene (LDPE) plastic, a rubber material, polyvinyl chloride (PVC), various types of resins, various types of resin epoxides, polyester, polypropylene, polyurethane, polyacrylate, and copolymers thereof, etc.). The body portion of the package carrying arrangement can be generally rectangular, circular and/or polygonal in shape; however, other shapes can be used, The handle portion of the package carrying arrangement can be rectangular, circular and/or polygonal in cross-sectional shape; however, other shapes can be used. The thickness of the material used to form the package carrying arrangement is non-limiting. In one non-limiting embodiment, the thickness of the material used to form at least the body portion and/or the handle portion is about 0.1 mm to about 10 mm (and all values and ranges therebetween), typically about 0.5 mm to about 4 mm, and more typically about 0.8 mm-2 mm (e.g., 1.5 mm). However, other thicknesses can be used. In one non-limiting embodiment, the body portion can be about 6 inches to about 30 inches in length by about 4 to about 28 inches in width; however, this is not required.

In yet another and/or alternative non-limiting aspect of the invention, the body portion of the package carrying arrangement has a substantially planar body; however, this is not required. The body portion has a top surface and a bottom surface. The body portion can optionally include printing and/or embossing on the top and/or bottom surface. The body portion can have various structures on the top and/or bottom surface. In one non-limiting arrangement, the body portion has structural enhancing structures on the top and/or bottom surface; however, this is not required. Such structural enhancing structures include, but are not limited to, ribs, raised portions, etc. The structural enhancing structures can be used to enhance the rigidity, strength, etc. of the body portion; however, this is not required. Additionally or alternatively, the structural enhancing structures can be used to improve the aesthetics of the body portion (e.g., form designs, wording, etc.) The body portion tray can be formed as a one-piece construction; however, this is not required. The structural enhancing structures can be integrally formed with the body portion or be separate structures that are connected to the body portion by a connection means (e.g., adhesive, solder, weld bead, melted connection, rivet, screw, nail, pin, bolt, hood and loop fastener, tape, clamp, etc.).

In still yet another and/or alternative non-limiting aspect of the invention, the body portion of the package carrying arrangement, the top and/or bottom surface of the body portion can include one or more container flanges extending outwardly from the top or bottom surface of the body portion; however, this is not required. The one or more container flanges can extend outwardly from the body portion at an angle that is perpendicular or generally perpendicular (e.g., 80°-400°) to the top or bottom surface of the body portion; however, this is not required. As can be appreciated, only the top surface, only the bottom surface, or both the top and bottom surface of the body portion can include one or more container flanges. When both the top and bottom surfaces of the body portion include one or more container flanges, the orientation and spacing of the container flanges on the top and bottom surfaces can be the same or different. The shape and size of the one or more container flanges is non-limiting. In one non-limiting configuration, the top and bottom surfaces of the body portion include a plurality of container flanges that have the same shape and size and are positioned on opposite sides from one another such that the top and bottom sides have the exact same container flange configurations. The one or more container flanges can have a substantially arcuate and/or wave shape; however, this is not required.

In another and/or alternative non-limiting aspect of the invention, the one or more flanges can include a retaining arrangement (e.g., rib, finger, retaining flange, etc.) in the one or more container flanges. The size and shape of the retaining arrangement are non-limiting. The retaining arrangement is configured to facilitate in releasably securing one or more containers to the body portion. In one non-limiting arrangement, the retaining arrangement and/or other portion of the container flange is configured to frictionally engage one or more portions of a container; however, this is not required. In one non-limiting arrangement, one or more retaining arrangements are positioned on a container flange such that the retaining arrangement is spaced above the top or bottom surface of the panel portion; however, this is not required. In one non-limiting specific configuration, at least one retaining arrangement is positioned on a container flange and the retaining arrangement is spaced above the top or bottom surface of the panel portion at a distance that is at least 90% (e.g., 90%-150% and all values and ranges therebetween, etc.) the thickness of the rim on a container so that the rim of a container can be at least partially entrapped between retaining arrangement and the top or bottom surface of the panel portion; however, this is not required. In another non-limiting specific configuration, the width of the retaining arrangement is at least 2% the width of the rim on a container (e.g., 2%-500% and all values and ranges therebetween, etc.) such that when the rim of the container is at least partially entrapped between the retaining arrangement and the top or bottom surface of the panel portion, the retaining arrangement partially overlies the top of the rim of the container. The bottom surface of the retaining arrangement can be sloped, beveled, angled, etc. to facilitate in the insertion of the rim of the container at least partially under the retaining arrangement when a container is loaded on the panel portion; however, this is not required. In one non-limiting specific arrangement, the bottom of one or more retaining arrangements slopes upwardly and outwardly at an angle of about 20°-80° (and all values and ranges therebetween) from the vertical wall of the container flange and then optionally changes the angle of slope to 0°-30° from the vertical wall of the container flange; however, this is not required.

In another and/or alternative non-limiting embodiment of the present invention, the panel portion includes at least one pair of contain flanges on the top surface of the panel portion. The pair of container flanges is configured to releaseably secure one or more containers to the top surface of the panel portion. In one non-limiting arrangement, the one or more pair of container flanges is configured to releaseably secure one container to the top surface of the panel portion. In another non-limiting arrangement, the one or more pairs of container flanges is configured to releaseably secure two to five containers to the top surface of the panel portion. The orientation of the at least one or more pairs of container flanges on the panel portion is non-limiting. In one non-limiting arrangement, each of the one or more pairs of container flanges are positioned along the lateral axis of the panel portion; however, this is not required. In one specific configuration, the top surface includes two to five pairs of container flanges are oriented along the lateral axis of the panel portion. In another specific configuration, the top surface and bottom surface each include two to five pairs of container flanges are oriented along the lateral axis of the panel portion. In another non-limiting arrangement the container flanges are connected together; however, this is not required. The shape and size of the container flanges for each pair of container flanges can be the same or different. In one non-limiting arrangement, the size and configuration of the container flanges of the one or more pairs of container flanges is the same.

In another and/or alternative non-limiting embodiment of the present invention, the container flange includes a curved or arcuate portion that is configured to at least partially encircle a body of the container when the container is releaseable secured to the panel portion. Generally, the curved or arcuate portion of each container flange is configured to encircle at least about 10% (e.g., 10-80% and all values and ranges therebetween) of the body of the container when the container is releaseable secured to the panel portion, and typically about 15%-45% of the body of the container when the container is releaseable secured to the panel portion. In another non-limiting arrangement, the container flange includes two or more curved portions along the length of the container flange wherein each curved portion is configured to at least partially secure a different container to the panel portion; however, this is not required. In one non-limiting configuration, a pair of container flanges includes a first and second container flange that includes curved portions that are configured to retain two containers between the first and second container flanges, and wherein the first and second container flanges encircle about 20%-75% of the container body and container rim of each of the containers, and wherein the longitudinal length of the first and second container flange is along the latitudinal axis of the panel portion. The ends of the first and second container flanges can be configured to extend to or beyond the side edges of the panel portion or be spaced inwardly from the side edges of the panel portion. In a specific configuration, the top and/or bottom surfaces of the panel portion include three pairs of container flanges, when each pair of container flanges is configured to retain two containers, and wherein the first and second container flanges of each pair of container flanges extend along the latitudinal axis of the panel portion. In another non-limiting arrangement, the height of one or more of the container flanges is less than the height of the container such that when the container is releasably connected to the container flange, at least a portion of the body of the container extends above a top surface of the container flange; however, this is not required. Generally, the ratio of the height of the container to the height of the container flange that at least partially engages the container is 0.8-20:1, and typically 1-20:1, more typically 1.1-15:1, and still more typically 1.5-6:1; however, other ratios can be used.

In yet another and/or alternative non-limiting embodiment of the present invention, the handle portion on the package carrying arrangement is located at the top end of the panel portion; however, this is not required. At least a portion of the handle portion can be connected to a container flange and/or the panel portion. The size and shape of the handle portion is non-limiting. The thickness of the handle portion can be the same as or greater than the thickness of the panel portion; however, this is not required. The handle portion can include one or more structural flanges to increase the strength and/or rigidity of the handle portion; however, this is not required.

In still another and/or alternative non-limiting embodiment of the present invention, the package carrying arrangement can include one or more base flanges that are configured to enable the package carrying arrangement to stand upright on a surface via the base flanges; however, this is not required. At least a portion of the one or more base flanges can be connected to a container flange and/or the panel portion. The size and shape of the one or more base flanges is non-limiting. Generally, the one or more base flanges are located at the opposite end from the handle portion; however, this is not required.

In still yet another and/or alternative non-limiting aspect of the invention, a friction arrangement and/or entrapment arrangement can be used to releasably secure a container (e.g., a can, etc.) to the package carrying arrangement; however, this is not required. The friction arrangement and/or entrapment arrangement can be configured to enable a container to be pushed inward between two opposing container flanges; however, this is not required. In one non-limiting arrangement, the act of pushing the container between two opposing container flanges causes one or more portions of one or both container flanges to deform and/or move in position to enable the container to be positioned between the two opposing container flanges and, thereafter, the opposing flanges move partially or fully back to the same shape and/or position prior to the container being inserted between the two opposing container flanges; however, this is not required. When the container is located between the two opposing container flanges, the container can frictionally engaged the two opposing container flanges; however, this is not required. When the container is removed from the two opposing container flanges, the container can be pulled from the package carrying arrangement to thereby again cause one or more portions of one or both container flanges to deform and/or move in position to enable the container to be removed from between the two opposing container flanges and, thereafter, the opposing flanges move partially or fully back to the same shape and/or position prior to the container being inserted between the two opposing container flanges; however, this is not required.

In still yet another and/or alternative non-limiting aspect of the present invention, the container flanges are configured to prevent the containers on the panel portion from contacting one another; however, this is not required.

In another and/or alternative non-limiting aspect of the present invention, the panel portion can optionally include one or more position flanges configured to limit the position of a container that is loaded into the panel portion; however, this is not required. In one non-limiting arrangement, the position flange limits the distance that a container can be moved relative to the panel portion as the container is inserted between two opposing container flanges as the container is loaded on the panel portion; however, this is not required. In one non-limiting arrangement, the position flange includes a portion that extends upwardly from the top or bottom surface of the panel portion and is configured to engage the body or rim of the container when the container is being loaded onto the panel portion; however, this is not required. Generally, the position flange is positioned between two opposing container flanges; however, this is not required. The portion of the position flange that extends upwardly from the top or bottom surface of the panel portion can be curved so as to conform to the shape of the container or rim that contacts the position flange; however, this is not required. The position flange can be configured to be movable relative to the top or bottom surface of the panel portion; however, this is not required. In another non-limiting configuration, one or more position flanges can be biased at an angle of from about 1-20° from the top or bottom surface of the panel portion; however, this is not required. The position flange can be configured to slightly deform or move relative to the top or bottom surface of the panel portion as a container is inserted on the panel portion and the container moves over a portion of the position flange. In one specific configuration, the position flange is caused to be pushed downwardly as the container is moved over a portion of the position flange to create friction with the container to thereby facilitate in securing the container on the panel portion and to inhibit or prevent movement of the container when the container is releasably secured to the panel portion.

In yet another and/or alternative non-limiting aspect of the invention, the handle portion can be optionally detachable from the body portion; however, this is not required. The handle portion is configured to enable easy and convenient carrying of the package carrying arrangement. The handle portion can include a plurality of surface projections for an ergonomic fit to a user's hand; however, this is not required. The handle portion can include an impression and/or groove for the purpose of displaying information; however, this is not required. The handle portion can include an impressed zone; however, this is not required. The impressed zone on the handle portion (when used) is capable of providing information; however, this is not required. As can be appreciated, various types of markings can be included on the handle portion and/or impressed zone (e.g., brand name, etc.); however, this is not required.

In still yet another and/or alternative non-limiting aspect of the invention, the panel portion can include an aperture that is configured to connect the handle portion to the panel portion; however, this is not required. The handle portion can optionally include a flexible strap; however, this is not required. The handle portion can be configured to be detachable from the panel portion; however, this is not required. In one non-limiting arrangement, a first end of a handle portion can be releasably attached to one portion of the panel portion and a second end of said handle portion can be releasably attached (e.g., buckles, hook and loop fastener, latches, snap locks, etc.) to a different portion of the panel portion; however, this is not required. The handle portion can be configured to connect together and/or function as a handle for two panel portions; however, this is not required.

In another and/or alternative non-limiting aspect of the invention, there is provided a method for loading a package carrying arrangement with one or more containers including the steps of: 1) pushing a container inward between two opposing container flanges such that the two opposing container slightly deform and/or flex outwardly; and 2) continuing to push the container inward to its final portion on the panel portion.

One non-limiting object of the present invention is the provision of a package carrying arrangement configured to conveniently transport a plurality of containers.

Another and/or alternative non-limiting object of the present invention is the provision of a package carrying arrangement configured to enable convenient loading, unloading and transporting of a plurality of containers.

Still yet another and/or alternative non-limiting object of the present invention is the provision of a package carrying arrangement configured to releasably secure a plurality of containers.

These and other objectives will become apparent to those skilled in the art upon reading and following the description taken together with the accompanied drawings.

BRIEF DESCRIPTION OF THE DRAWINGS

Reference may now be made to the drawings which illustrate various non-limiting embodiments that the invention may take in physical form and in certain parts and arrangements of parts wherein.

DETAILED DESCRIPTION OF THE NON-LIMITING EMBODIMENTS

Figure 1:
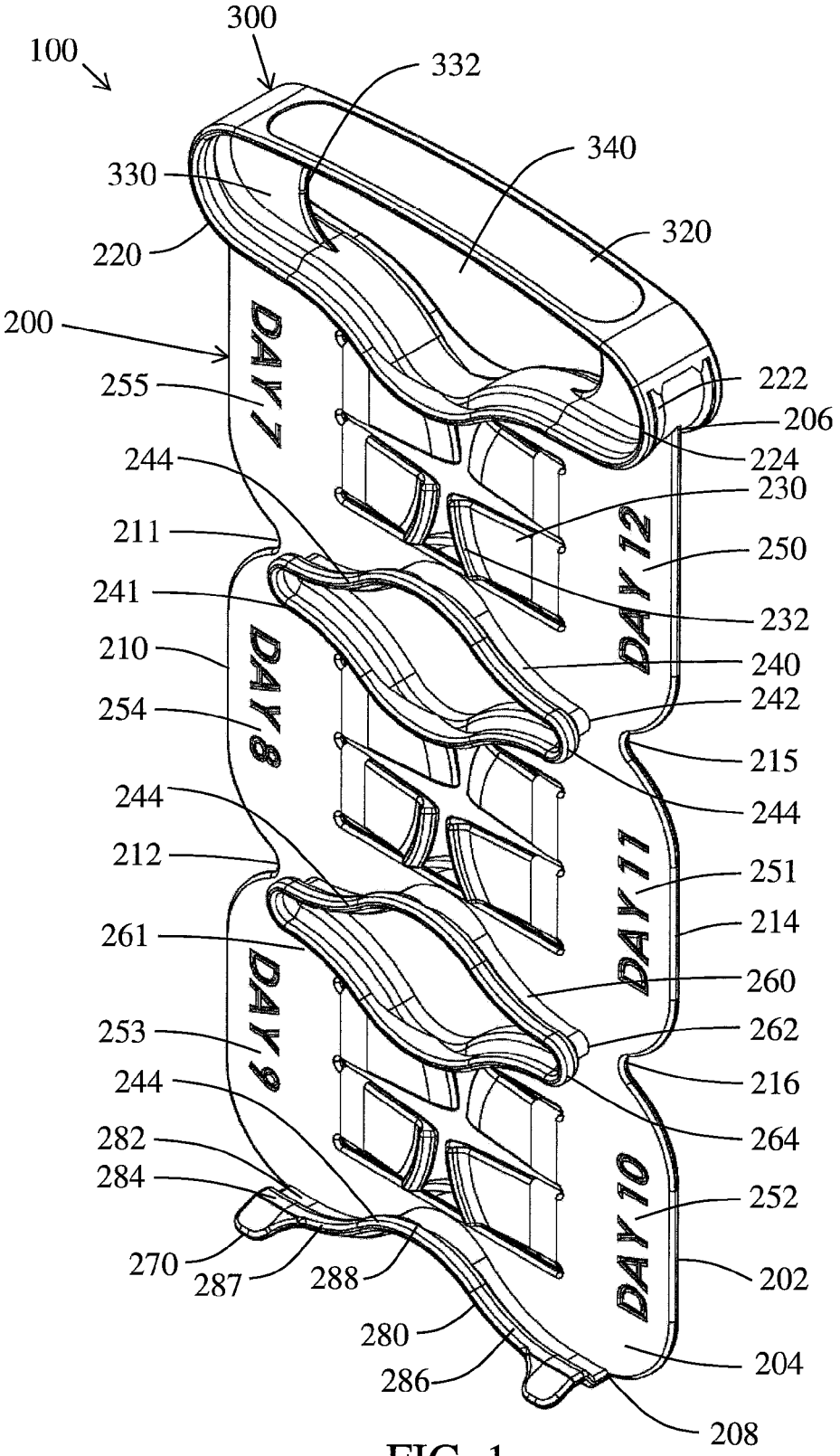
FIG. 1 is a perspective illustration of a non-limiting package carrying arrangement according to the present invention.

Referring now to the drawings wherein the showings are for the purpose of illustrating non-limiting embodiments of the invention only and not for the purpose of limiting the same, FIGS. 1-11 illustrate various non-limiting embodiments of the package carrying arrangement in accordance with the present invention.

Figure 2:
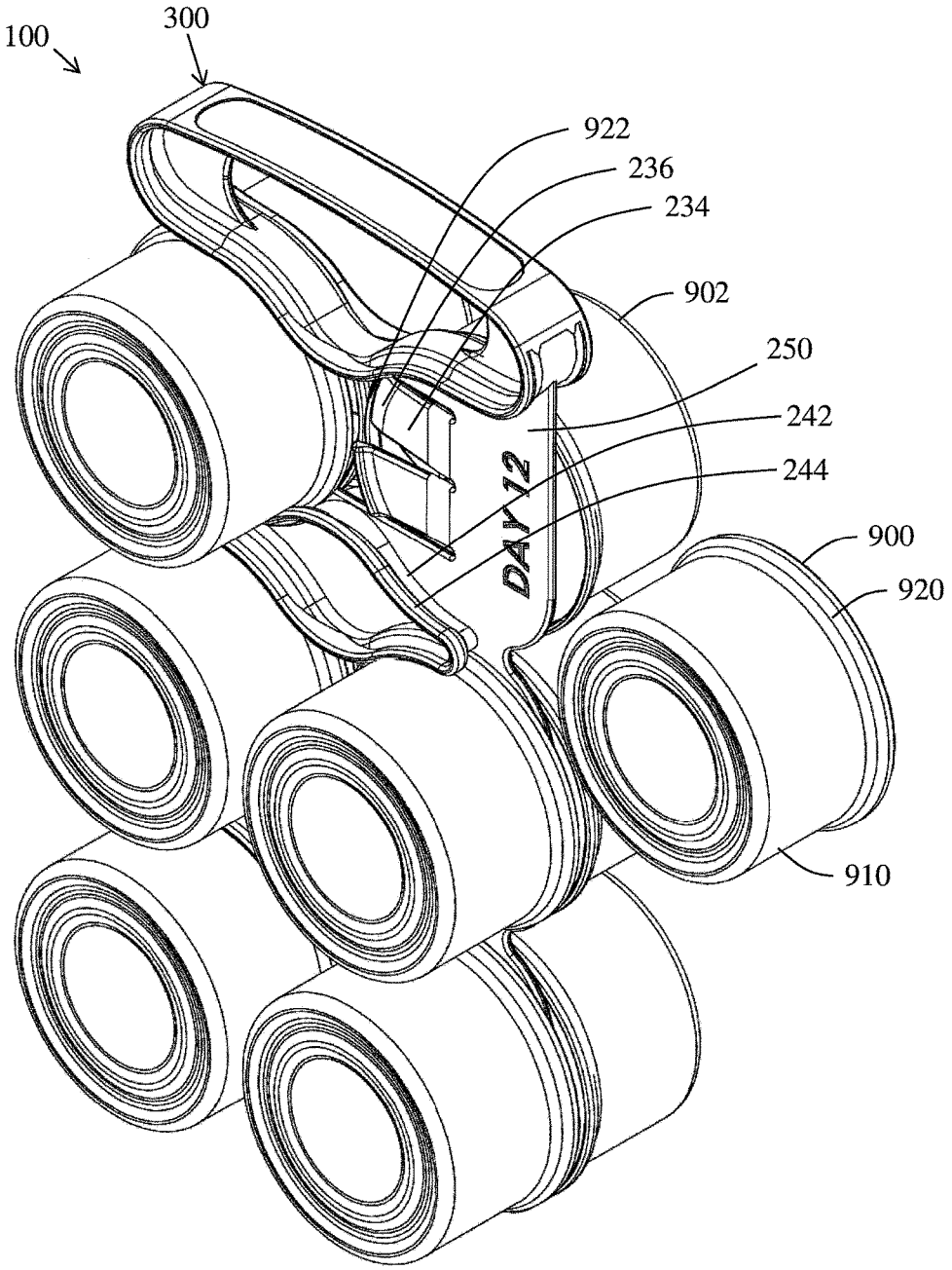
FIG. 2 is a perspective illustration of the package carrying arrangement of FIG. 1 that includes a plurality of containers loaded on the package carrying arrangement.
Figure 3:
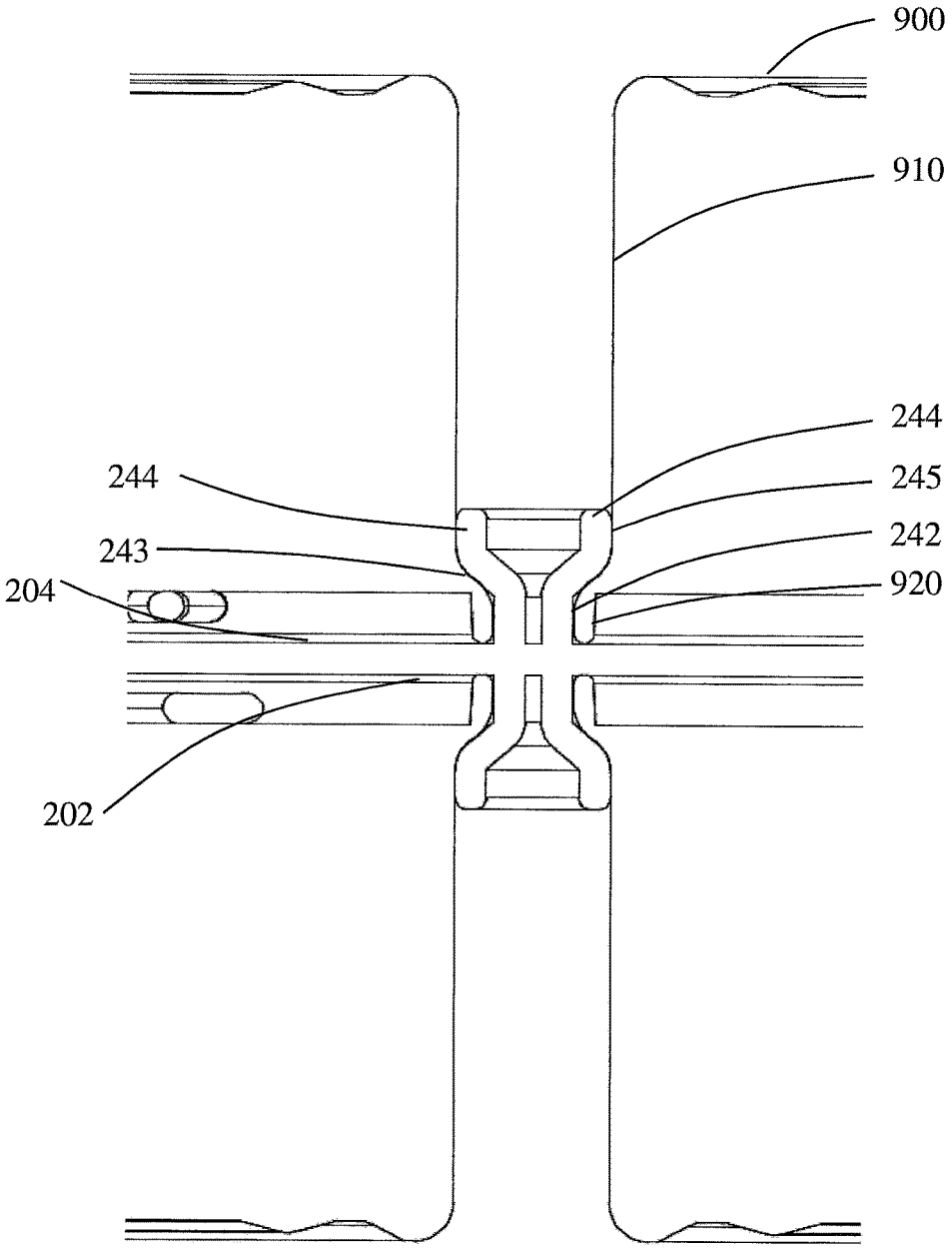
FIG. 3 is an enlarged cross-sectional perspective illustration of the package carrying arrangement of FIG. 2 illustrating the arrangement for retaining containers on the package carrying arrangement.

Referring now to FIGS. 1-3, there is illustrated a package carrying arrangement 100 that includes a panel portion 200 and a handle portion 300. The panel portion is not limited in size, shape, material or color. Generally, the panel portion is formed of a durable material such as a plastic material; however, other or additional materials can be used. The panel portion includes a first longitudinal side edge 210 and a second longitudinal side edge 214. First longitudinal side edge 210 can optionally include a first and second indentation and/or cut-out 211, 212. Similarly, second longitudinal side edge 214 can optionally include a first and second indentation and/or cutout 215, 216. The shape and size of the indentations or cut-outs 211, 212, 215, 216 (when used) are non-limiting.

The panel portion has a top surface 202 and a bottom surface 204. The top and/or bottom surfaces can include information (labels, barcode stickers, day counts, brand names, adverting etc.); however, this is not required. The information (when used) can be on a label or other printed material positioned on the panel portion, embossed on the panel portion, and/or printed on the panel portion; however, this is not required. As illustrated in FIG. 1, the bottom surface includes printing for day counts 7-12. The top surface (not shown) can include printing for day counts 1-6.

The package carrying arrangement includes a handle portion 300 that is located at the front end 206 of the panel portion. The size and shape of the handle portion are non-limiting. Generally, the handle portion is integrally formed with and non-detachable from the panel portion; however, it can be appreciated that the handle portion can be configured to be detachable from the panel portion. The handle portion can optionally include an impressed zone 320. The impressed zone can optionally include a label or other printed material positioned on the handle portion, embossed on the handle portion, and/or printed on the handle portion; however, this is not required.

The handle portion allows a user to conveniently carry the package carrying arrangement. The handle portion can optionally include flanges 330 that can be used to add strength and rigidity to the handle portion; however, this is not required. The innermost edge 332 of flange 330 (when used) can be arcuate shaped; however, this is not required. The handle portion includes an opening 340 by which the package carrying arrangement can be held by a user. Opening 340 is not limited by size or shape.

As can be appreciated, the package carrying arrangement can be designed for use with two or more handle portions; however, this is not required.

The back end 208 of the package carrying arrangement can optionally include one or more base flanges 270 that are configured to enable the package carrying arrangement to stand upright on a surface via the base flanges; however, this is not required. The number of base flanges, and the size and shape of the base flanges, are non-limiting. As illustrated in FIG. 1, the package carrying arrangement includes four base flanges, wherein both the top and bottom surfaces of the package carrying arrangement includes two base flanges; however, this is not required. Generally, the base flanges are integrally formed with and non-detachable from the panel portion and/or container flanges; however, it can be appreciated that the base flanges, when used, can be configured to be detachable.

Provided on the bottom surface of the panel portion are a plurality of outwardly extending container flanges extending upwardly from the bottom surface. As illustrated in FIG. 1, the bottom surface 204 of the panel portion includes six container flanges 220, 240, 241, 260, 261, 280. As can be appreciated, container flanges can be positioned on the top surface of the panel portion such that the structures on the top and bottom surfaces of the panel portion are mirror images of one another; however, this is not required. Each of the container flanges 220, 240, 241, 260, 261, 280 can have an arcuate and/or wave shape in transverse cross-section; however, other or additional shapes can be used. For example, container flange 280 includes a first arcuate portion 286, a second arcuate portion, 287 and a transition portion 288 positioned between the first and second arcuate portions that can also be arcuate. The first and second arcuate portions are configured to engage a portion of a container that is positioned on the panel portion. The transition portion, which can have a shape other than an arcuate shape, merely separates the first and second arcuate portions from one another. The radius of curvature of the first and second arcuate portions is generally the same. Generally, the radius of curvature is equal to or slightly larger or small (±10%) than the radius of the container that is to be inserted into the panel portion; however, this is not required. For example, when the package carrying arrangement is configured to carry container having a diameter of four inches, the radius of curvature is about two inches ±10% (e.g., 1.8-2.4 inches). When the transition portion is arcuate, the radius of curvature of the transition portion can be the same or different from the radius of curvature of the first and second arcuate portions. In the non-limiting embodiment illustrated in FIG. 1, the inner surface of the container flanges contains no straight edges and is continuously curved along the longitudinal length of the container flange; however, this is not required. The container flanges 220, 240, 241, 260, 261, 280 can extend partially or completely from first longitudinal side edge 210 to second longitudinal side edge 214. As illustrated in FIG. 1, container flanges 220, 240, 241, 260, 261, 280 are spaced inwardly from first longitudinal side edge 210 and second longitudinal side edge 214.

As illustrated in FIG. 1, container flanges 220 and 240 have side faces that face one another. One or more containers 900 are designed to be releasably retained between container flanges 220 and 240. Likewise, container flanges 241 and 260 have a side face that faces one another. One or more containers 900 are designed to be releasably retained between container flanges 241 and 260. Also, container flanges 261 and 280 have side faces that face one another. One or more containers 900 are designed to be releasably retained between container flanges 261 and 280. The portions of the faces of the container flanges facing one another mirror one another; however, this is not required. As illustrated in FIG. 2, each pair of facing container flanges is configured to releasably connect up to two containers to the panel portion.

The ends of container flanges 240 and 241 are illustrated as being connected together; however, this is not required. Likewise, the ends of container flanges 260 and 261 are illustrated as being connected together; however, this is not required. As illustrated in FIG. 1, indentations 211, 212, 215, 216 line up with the connected ends of the container flanges; however, this is not required. As illustrated in FIG. 1, and opening in the panel portion can exist between connected container flanges 240, 241 and/or connected container flanges 260, 261; however, this is not required.

Referring now to FIGS. 1-3, the side face of each of the container flanges includes retaining arrangement in the form of a retaining rib 244. The bottom portion 242 of the container flange extends upwardly (e.g., perpendicular to the surface, etc.) from the top or bottom surface of the panel portion. The retaining rib is illustrated as being spaced upwardly from the top or bottom surface of the panel portion. The bottom portion 243 of the retaining rib is illustrated as sloping outwardly from the side face of the container flange; however, this is not required. The upper portion 245 of the retaining rib has a side face that is illustrated as being parallel to the side face of the bottom portion of the container flange; however, this is not required. As can be appreciated, the configuration of the retaining rib can have other configurations.

As illustrated in FIG. 3, when a container 900 is inserted into the panel portion, the rim 920 of the container is positioned at least partially under the bottom portion 643 of the retaining rib, and is thus prevented by the retaining rib from moving upwardly past the retaining rib. The thickness of the retaining rib is selected to overlie at least a portion of rim 920, but still allow the body 910 of the container to extend upwardly and past the retaining rib as illustrated in FIG. 3. As illustrated in FIG. 3, the upper portion of the retaining rib is in contact with the body of the container when the container is releaseably connected by the container flanges to the panel portion; however, this is not required. As also illustrated in FIG. 3, the retaining rib is in contact with the rim of the container when the container is releaseably connected by the container flanges to the panel portion; however, this is not required.

Panel portion 200 can optionally include one or more position flanges 230. The position flanges are illustrated as being movable relative to the top or bottom surface of the panel portion; however, this is not required. The end of each of the position flanges includes a lip and/or hook 232; however, this is not required. The position flanges (when used) are configured to limit the distance a container can be slid between the container flanges. The lip 232 is configured to engage the rim and/or body of the container once the container has been slid a certain distance between the container flanges and thereafter inhibit or prevent the container from further being slid inwardly; however, this is not required. The position flange can optionally be biased in a position with an angle of from about 5-10° relative to the top or bottom surface of the panel portion; however, this is not required. As can be appreciated, the angle of the position flange can be less or greater than 5-10°. The biased position of the position flange can be used to facilitate in creating a friction engagement between the container and the position flange and/or the container and the retaining rib; however, this is not required. Such friction engagement can be used to improve the connection of the container to the package carrying arrangement and/or to limit the movement of the container when connected to the package carrying arrangement; however, this is not required.

Referring now to FIG. 1, container flange 220 is illustrated as being at least partially integrally formed with handle portion 300; however, this is not required. Also, container flange 280 is illustrated as being at least partially integrally formed with base flanges 270; however, this is not required.

FIG. 1 illustrates the bottom surface of the panel portion and the structures on the bottom surface. As can be appreciated, the top surface of the panel portion can have the same structures and configuration as the bottom surface of the panel portion. The symmetry of both sides of the panel portion is illustrated in FIGS. 2 and 3.

Referring now to FIGS. 2 and 3, up to six containers can be releasably connected to the bottom side of the panel portion. When the top surface of the panel portion also or alternatively has the same structures and configures as the bottom side of the panel portion as illustrated in FIG. 1, up to six containers can be releasably connected to the top surface of the panel portion. As can be appreciated, the number of container that can be releasably connected to each of the top and bottom surfaces of the panel portion is non-limiting.

In use, a container 900 (e.g., can, etc.) can be pushed into position on the panel portion with the lid 920 of the container facing the top or bottom surface of the panel portion. As the container is pushed into position, the container flanges can frictionally engage with the container. As illustrated in FIG. 1, the package carrying arrangement includes a plurality of container cavities 250, 251, 252, 253, 254, 255 that are configured to each releasably secure a container to the panel portion. Each container cavity is configured to receive a container from the side of the package carrying arrangement. FIG. 3 illustrates five containers that have been releasably secured to the bottom surface of the panel portion and a sixth container that is positioned to be inserted into container cavity 250. During the securing process of the container into container cavity 250, the container is oriented such that the top of the container faces the bottom surface of panel portion 200. Thereafter, the container is moved toward second longitudinal side edge 214 to the front opening of container cavity 250. The container is continued to be inserted into container cavity 250 such that the container rim 920 at least partially passes under retaining rib 244 while the body of the container pass by the retaining rib 244 as illustrated in FIG. 3. As the container is inserted between container flanges 220, 240, at least a portion of one or both of the container flanges flexes or deforms to allow the middle of the container to pass between the two container flanges. The container is continued to be pushed into the container cavity 250 until the container rim and/or container body contacts lip 232 of position tab 230, thereby inhibiting or preventing further sliding of the container into container cavity 250. When the container is fully positioned in a container cavity, the container flange generally encircles about 15-70% the outer perimeter of the container.

When the container is to be removed from the package carrying arrangement, the container is pulled outwardly from the container cavity. As the container is pulled from the container cavity, at least a portion of one or both of the container flanges flexes or deforms to allow the middle of the container to pass between the two container flanges and out of the container cavity. The procedure above for inserting and removing containers on the package carrying arrangement can be repeated for each of the container cavities on the package carrying arrangement.

When the package carrying arrangement is partially or fully loaded with containers, the package carrying arrangement can be easily carried by the handle portion. When the package carrying arrangement includes base flanges, the package carrying arrangement can be stood upright on the base flanges.

As illustrated in FIG. 1, the package carrying arrangement can include printing that indicates the day a container is to be used. Such printing can be useful when the package carrying arrangement is used to hold pet food cans.

Referring now to FIGS. 4-7, another and/or alternative non-limiting embodiment of the package carrying arrangement is illustrated in accordance with the present invention. The package carrying arrangement is very similar to the package carrying arrangement illustrated in FIGS. 1-3 except that the container flanges are configured a little differently from the container flanges described above with reference to FIGS. 1-3 and the optional position flanges illustrated in FIGS. 1-3 are absent from the package carrying arrangement illustrated in FIGS. 4-7. Many of the features of the package carrying arrangement illustrated in FIGS. 4-7 and the manner in which the package carrying arrangement is used are the same as the package carrying arrangement illustrated in FIGS. 1-3, thus will not be repeated herein.

Figure 4:
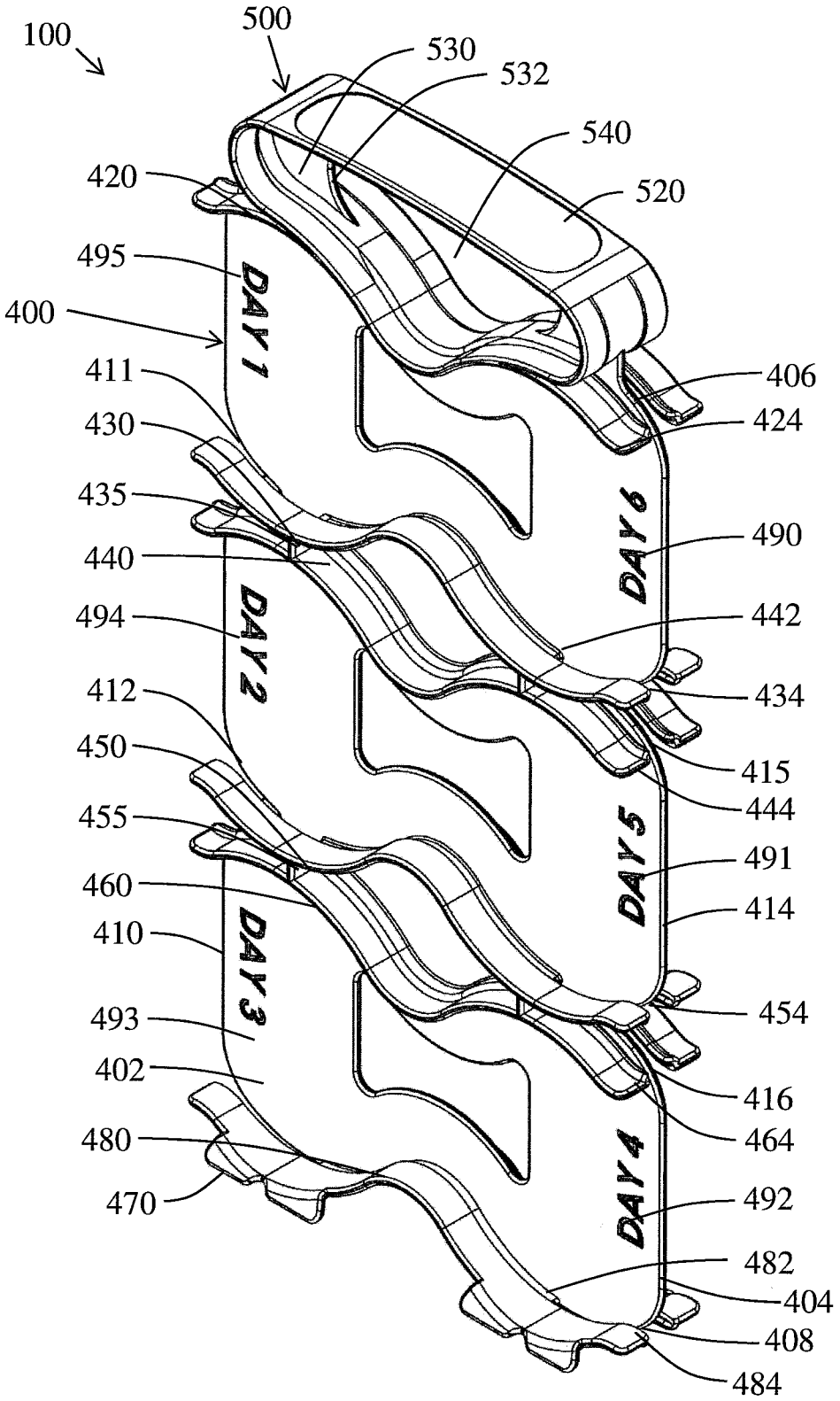
FIG. 4 is a perspective illustration of the top surface of another non-limiting package carrying arrangement according to the present invention.
Figure 5:
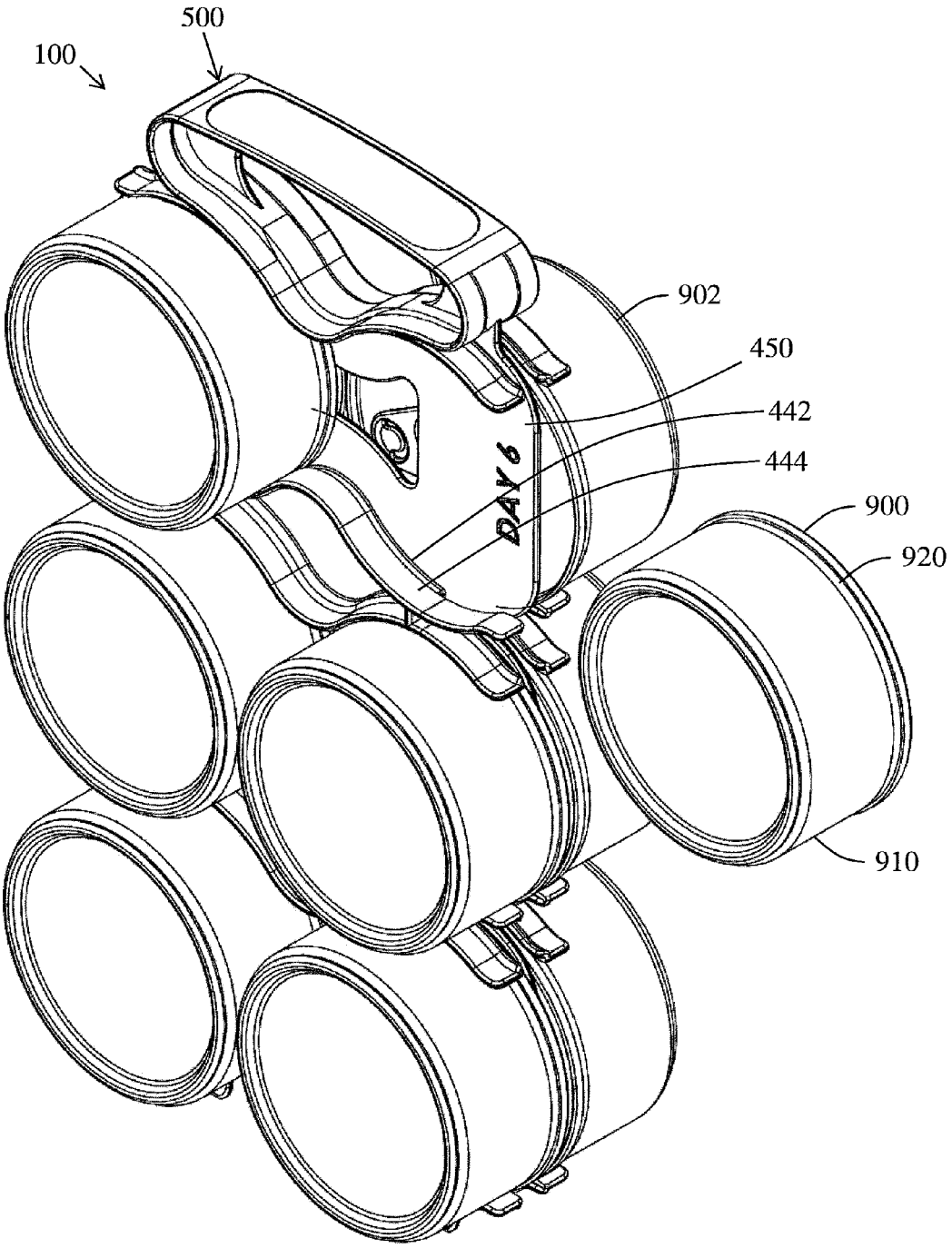
FIG. 5 is a perspective illustration of the package carrying arrangement of FIG. 4 that includes a plurality of containers loaded on the package carrying arrangement.

As illustrated in FIGS. 4-5, the package carrying arrangement 100 includes a panel portion 400 and a handle portion 500. The panel portion is not limited in size, shape, material or color. The panel portion includes a first longitudinal side edge 410 and a second longitudinal side edge 414. First longitudinal side edge 410 can optionally include a first and second indentation and/or cut-out 411, 412. Similarly, second longitudinal side edge 414 can optionally include a first and second indentation and/or cut-out 415, 416. The shape and size of the indentations or cut-outs 411, 412, 415, 416 (when used) are non-limiting.

Figure 7:
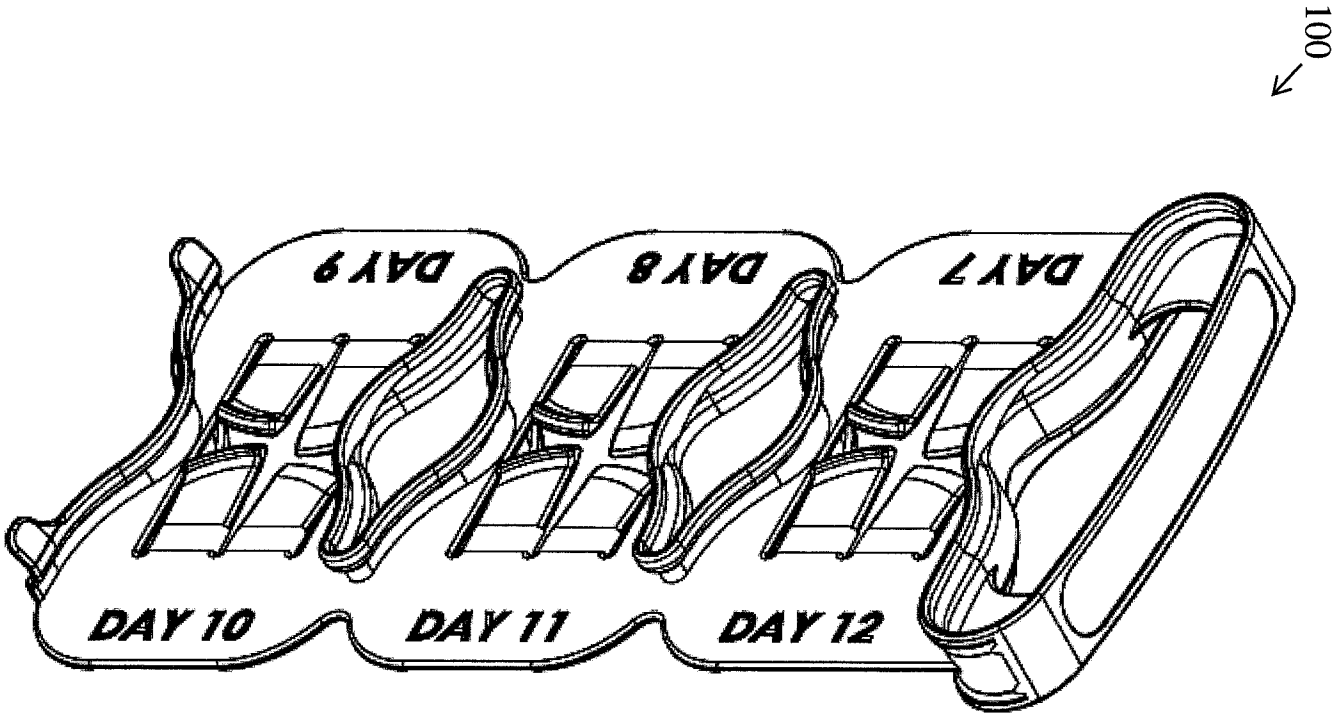
FIG. 7 is a perspective illustration of the bottom surface of the package carrying arrangement if FIG. 4.

The panel portion has a top surface 402 and a bottom surface 404. The top and/or bottom surfaces can include information (labels, barcode stickers, day counts, brand names, adverting etc.); however, this is not required. The information (when used) can be on a label or other printed material positioned on the panel portion, embossed on the panel portion, and/or printed on the panel portion; however, this is not required. As illustrated in FIG. 4, the top surface includes printing for day counts 1-6. The bottom surface as illustrated in FIG. 7 can include printing for day counts 7-12 similar to the printing on the package carrying arrangement illustrated in FIG. 1; however, this is not required.

The package carrying arrangement includes a handle portion 500 that is located at the front end 406 of the panel portion. The size and shape of the handle portion are non-limiting. Generally, the handle portion is integrally formed with and non-detachable from the panel portion; however, it can be appreciated that the handle portion can be configured to be detachable from the panel portion. The handle portion can optionally include an impressed zone 520. The impressed zone can optionally include a label or other printed material positioned on the handle portion, embossed on the handle portion, and/or printed on the handle portion; however, this is not required.

The handle portion allows a user to conveniently carry the package carrying arrangement. The handle portion can optionally include flanges 530 that can be used to add strength and rigidity to the handle portion; however, this is not required. The innermost edge 532 of flange 530 (when used) can be arcuate shaped; however, this is not required. The handle portion includes an opening 540 by which the package carrying arrangement can be held by a user. Opening 540 is not limited by size or shape.

As can be appreciated, the package carrying arrangement can be designed for use with two or more handle portions; however, this is not required.

The back end 408 of the package carrying arrangement can optionally include one or more base flanges 570 that are configured to enable the package carrying arrangement to stand upright on a surface via the base flanges; however, this is not required. The number of base flanges, and the size and shape of the base flanges, are non-limiting. As illustrated in FIG. 4, the package carrying arrangement includes four base flanges, wherein each of the top and bottom surfaces of the package carrying arrangement includes two base flanges; however, this is not required. Generally, the base flanges are integrally formed with and non-detachable from the panel portion and/or container flanges; however, it can be appreciated that the base flanges (when used) can be configured to be detachable.

Provided on the top surface of the panel portion are a plurality of outwardly extending container flanges that extend upwardly from the top surface of the panel portion. As illustrated in FIG. 4, the top surface 402 of the panel portion includes six container flanges 420, 430, 440, 450, 460, 480. As can be appreciated, container flanges can be positioned on the bottom surface of the panel portion such that the structures on the top and bottom surfaces of the panel portion are mirror images of one another as illustrated in FIGS. 4 and 7; however, this is not required. Each of the container flanges 420, 430, 440, 450, 460, 480 can have an arcuate and/or wave shape in transverse cross-section; however, other or additional shapes can be used. For example, each of the container flanges can include a first arcuate portion, a second arcuate portion, and a transition portion positioned between the first and second arcuate portions that can also be arcuate. The first and second arcuate portions are configured to engage a portion of a container that is positioned on the panel portion. The transition portion, which can have a shape other than an arcuate shape, merely separates the first and second arcuate portions from one another. The radius of curvature of the first and second arcuate portions is generally the same. Generally, the radius of curvature is equal to or slightly larger or small (±10%) than the radius of the container that is to be inserted into the panel portion; however, this is not required. When the transition portion is arcuate, the radius of curvature of the transition portion can be the same or different from the radius of curvature of the first and second arcuate portions. In the non-limiting embodiment illustrated in FIG. 4, the inner surface of the container flanges contains no straight edges and are continuously curved along the longitudinal length of the container flange; however, this is not required. The container flanges can extend partially or completely from first longitudinal side edge 410 to second longitudinal side edge 414.

As illustrated in FIG. 4, container flanges 420 and 430 have side faces that face one another. One or more containers 900 are designed to be releasably retained between container flanges 420 and 430. Likewise, container flanges 440 and 450 have side faces that face one another. One or more containers 900 are designed to be releasably retained between container flanges 440 and 450. Also, container flanges 460 and 480 have side faces that face one another. One or more containers 900 are designed to be releasably retained between container flanges 450 and 480. The portions of the faces of the container flanges facing one another mirror one another; however, this is not required. As illustrated in FIG. 4, each pair of facing container flanges is configured to releasably connect up to two containers to the panel portion.

Container flanges 430 and 440 are illustrated as being spaced apart and connected together via two connection flanges 435; however, this is not required. Likewise, the container flanges 450 and 460 are illustrated as being spaced apart and being connected together via two connection flanges 455; however, this is not required. As can be appreciated, the container flanges can be optionally connected together by other arrangements. As illustrated in FIG. 4, indentations 411, 412, 415, 416 line up with the connected ends of the container flanges; however, this is not required. As illustrated in FIG. 4, an opening in the panel portion can exist between connected container flanges 430, 440 and/or connected container flanges 450, 460; however, this is not required.

Connected to each end of each of the container flanges is an optional flexible flange portion 424, 434, 444, 454, 464, 484; however, this is not required. All or a portion of the bottom of the flexible flange portion is spaced from the top or bottom surface of the panel portion. This spacing enables the flexible flange portion to flex outwardly from a container that is being inserted between or removed from two facing container flanges. The rear portion of the flexible flange portion is illustrated as being connected to the end of the container flanges. The rear portion of the flexible flange portion is illustrated as curving inwardly and having a radius of curvature that is generally the same or similar to the radius of curvature of the arcuate portion of the container flange that the flexible flange portion is connected to; however, this is not required. The front portion of the flexible flange portion is illustrated as curving outwardly; however, this is not required. The curvature of the front portion of the flexible flange portion facilitates in the insertion of the container between the flexible flange portions as the container is inserted between two container flanges; however, this is not required. The length of the front portion of the flexible flange portion can be equal to or less than the length of the rear portion of the flexible flange portion; however, this is not required. As illustrated in FIG. 4, the container flange and the flexible flange portion are at least partially integrally formed with one another; however, this is not required. The front end of the flexible flange is illustrated as extending to the side of the panel portion or beyond the panel portion; however, it can be appreciated that the front end of the flexible flange can be spaced inwardly of the side edge of the panel portion.

Figure 6:
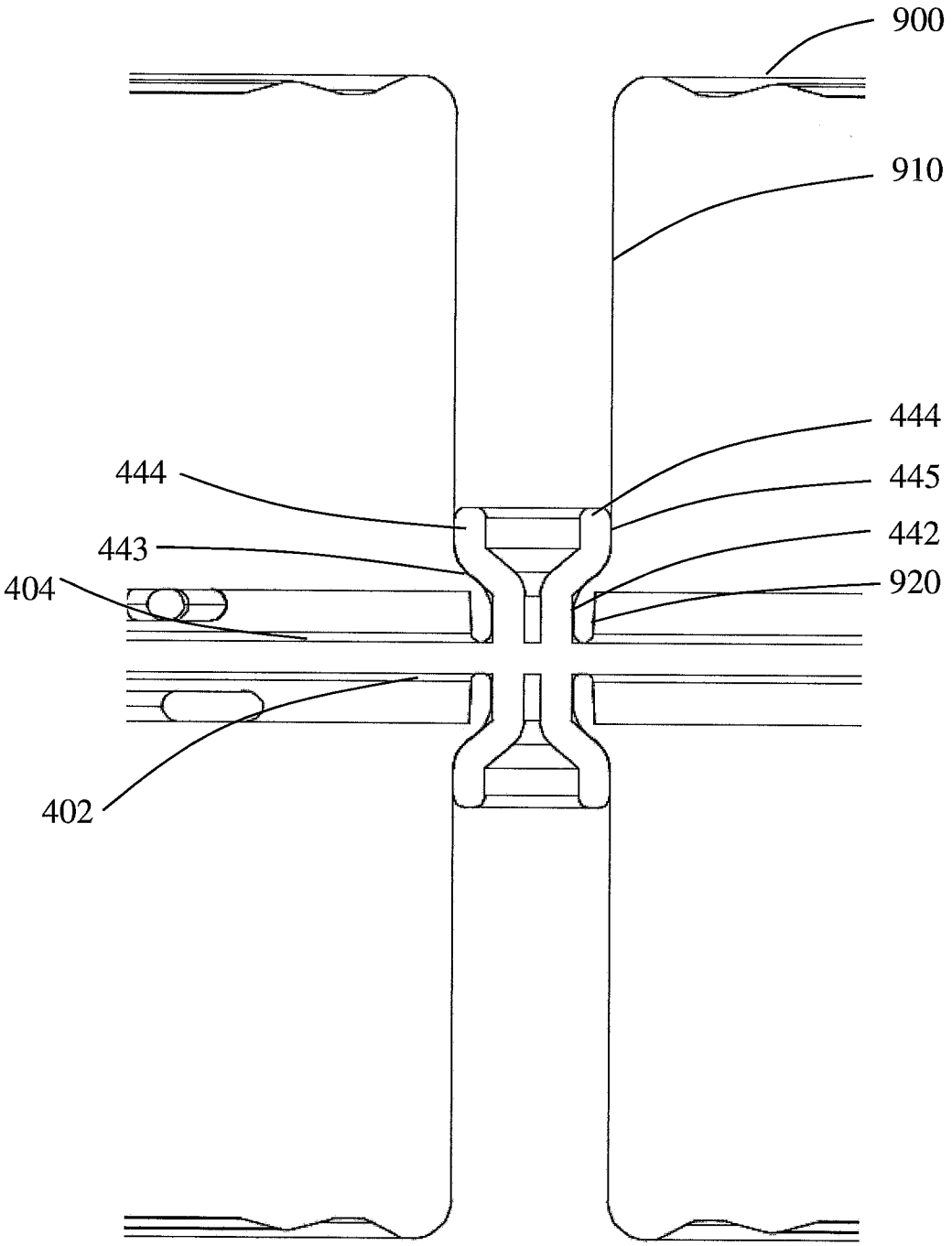
FIG. 6 is an enlarged cross-sectional perspective illustration of the package carrying arrangement of FIG. 5 illustrating the arrangement for retaining containers on the package carrying arrangement.

Referring now to FIGS. 4-6, the side face of each of the container flanges includes retaining arrangement in the form of a retaining rib 444. The bottom portion 442 of the container flange extends upwardly (e.g., perpendicular to the surface, etc.) from the top or bottom surface of the panel portion. The retaining rib is illustrated as being spaced upwardly from the top or bottom surface of the panel portion. The bottom portion 443 of the retaining rib is illustrated as sloping outwardly from the side face of the container flange; however, this is not required. The upper portion 445 of the retaining rib has a side face that is illustrated as being parallel to the side face of the bottom portion of the container flange; however, this is not required. As can be appreciated, the configuration of the retaining rib can have other configurations.

As illustrated in FIG. 6, when a container 900 is inserted on to the panel portion, the rim 920 of the container is positioned at least partially under the bottom portion 443 of the retaining rib, thus is prevented by the retaining rib from moving upwardly past the retaining rib. The thickness of the retaining rib is selected to overlie at least a portion of rim 920, but still allow the body 910 of the container to extend upwardly and past the retaining rib as illustrated in FIG. 6. As illustrated in FIG. 6, the upper portion of the retaining rib is in contact with the body of the container when the container is releaseably connected by the container flanges to the panel portion; however, this is not required. As also illustrated in FIG. 6, the retaining rib is in contact with the rim of the container when the container is releaseably connected by the container flanges to the panel portion; however, this is not required.

Panel portion 400 can optionally include one or more position flanges (not shown). The position flanges (when used) can be movable relative to the top or bottom surface of the panel portion; however, this is not required. The end of each of the position flanges can include a lip and/or hook; however, this is not required. The position flanges (when used) are configured to limit the distance a container can be slid between the container flanges. The lip is configured to engage the rim and/or body of the container once the container has been slid a certain distance between the container flanges and thereafter inhibit or prevent the container from further being slid inwardly; however, this is not required. The position flange can optionally be biased in a position with an angle of from about 5-10° relative to the top or bottom surface of the panel portion; however, this is not required. As can be appreciated, the angle of the position flange can be less or greater than 5-10°. The biased position of the position flange can be used to facilitate in creating a friction engagement between the container and the position flange and/or the container and the retaining rib; however, this is not required. Such friction engagement can be used to improve the connection of the container to the package carrying arrangement and/or to limit the movement of the container when connected to the package carrying arrangement; however, this is not required.

Referring now to FIG. 4, container flange 420 is illustrated as being at least partially integrally formed with handle portion 500; however, this is not required. Also, container flange 480 and flexible flange portion 484 are illustrated as being at least partially integrally formed with base flanges 470; however, this is not required.

FIG. 4 illustrates the top surface of the panel portion and the structures on the top surface. As can be appreciated, the bottom surface of the panel portion can have the same structures and configuration as the top surface of the panel portion as illustrated in FIG. 7. The symmetry of both sides of the panel portion is illustrated in FIGS. 4-7.

Referring now to FIGS. 5 and 6, up to six containers can be releasably connected to the top surface of the panel portion. When the bottom side of the panel portion as illustrated in FIG. 7 also or alternatively has the same structures and configures as the top surface of the panel portion as illustrated in FIG. 4, up to six containers can be releasably connected to the bottom side of the panel portion. As can be appreciated, the number of container that can be releasably connected to each of the top and/or bottom surfaces of the panel portion is non-limiting.

In use, a container 900 (e.g., can, etc.) can be pushed into position on the panel portion with the lid 920 of the container facing the top or bottom surface of the panel portion. As the container is pushed into position, the flexible flange portions on the container flanges engage the container body and are caused to flex and separate from one another. As illustrated in FIG. 4, the package carrying arrangement includes a plurality of container cavities 490, 491, 492, 493, 494, 495 that are configured to each releasably secure a container to the panel portion. Each container cavity is configured to receive a container from the side of the package carrying arrangement. FIG. 5 illustrates five containers that have been releasably secured to the top surface of the panel portion and a sixth container that is positioned to be inserted into container cavity 490. During the securing process of the container into container cavity 490, the container is oriented such that the top of the container faces the top surface of panel portion 400. Thereafter, the container is moved toward second longitudinal side edge 414 to the front opening of container cavity 490. The container is continued to be moved into container cavity 490 such that the body of the container engages the front portion of flexible flange portion 424 of container flange 420 and flexible flange portion 434 of container flange 430. As the container is continued to be moved into container cavity 490, the flexible flange portions 424, 434 are caused to flex outwardly and away from one another such that the container can pass between the flexible flange portions. The smallest distance between the front portion of flexible flange portion 424 of container flange 420 and flexible flange portion 434 of container flange 430 is generally less than the diameter of the body of the container; however, this is not required. As the body of the container is moved past the front portion of flexible flange portions, container rim 920 at least partially passes under retaining rib 444 while the body of the container passes by the retaining rib 444. A portion of container flanges 420, 430 can be configured to at least partially flexes or deforms as the container passes between the two container flanges; however, this is not required. As the container is moved fully past the flexible flange portions, container flanges 420, 430 partially or fully flex back to their original positions. When the container is fully positioned in a container cavity, the container flange and the flexible flange portions generally encircle about 15-70% the outer perimeter of the container. When the container is to be removed from the package carrying arrangement, the container is pulled outwardly from the container cavity. As the container is pulled from the container cavity, at least a portion of one or both of the container flanges can optionally flex or deform to allow the middle of the container to pass between the two container flanges and out of the container cavity. As the body of the container moves past the flexible flange portions, flexible flange portions 424, 434 are caused to flex outwardly and away from one another such that the container can pass between the flexible flange portions. As the container is moved fully past the flexible flange portions, the flexible flange portions flex back to their original positions. The procedure above for inserting and removing containers on the package carrying arrangement can be repeated for each of the container cavities on the package carrying arrangement.

When the package carrying arrangement is partially or fully loaded with containers, the package carrying arrangement can be easily carried by the handle portion. When the package carrying arrangement includes base flanges, the package carrying arrangement can be stood upright on the base flanges.

Referring now to FIGS. 8-11, another and/or alternative non-limiting embodiment of the package carrying arrangement is illustrated in accordance with the present invention. The package carrying arrangement is very similar to the package carrying arrangement illustrated in FIGS. 4-7 except that only the top surface of the panel portion includes container flanges, the panel portion includes position flanges, and the handle portion is positioned on the bottom surface of the panel portion. Many of the features of the package carrying arrangement illustrated in FIGS. 8-11 and the manner in which the package carrying arrangement is used are the same as the package carrying arrangement illustrated in FIGS. 1-6, thus will not be repeated herein.

As illustrated in FIGS. 8-11, the package carrying arrangement 100 includes a panel portion 600 and a handle portion 700. The panel portion is not limited in size, shape, material or color. The panel portion includes a first longitudinal side edge 610 and a second longitudinal side edge 614. First longitudinal side edge 610 can optionally include a first and second indentation and/or cut-out 611, 612. Similarly, second longitudinal side edge 614 can optionally include a first and second indentation and/or cutout 615, 616. The shape and size of the indentations or cut-outs (when used) are non-limiting.

The panel portion has a top surface 602 and a bottom surface 604. The top and/or bottom surfaces can include information (labels, barcode stickers, day counts, brand names, adverting etc.); however, this is not required. The information (when used) can be on a label or other printed material positioned on the panel portion, embossed on the panel portion, and/or printed on the panel portion; however, this is not required.

Figure 9:
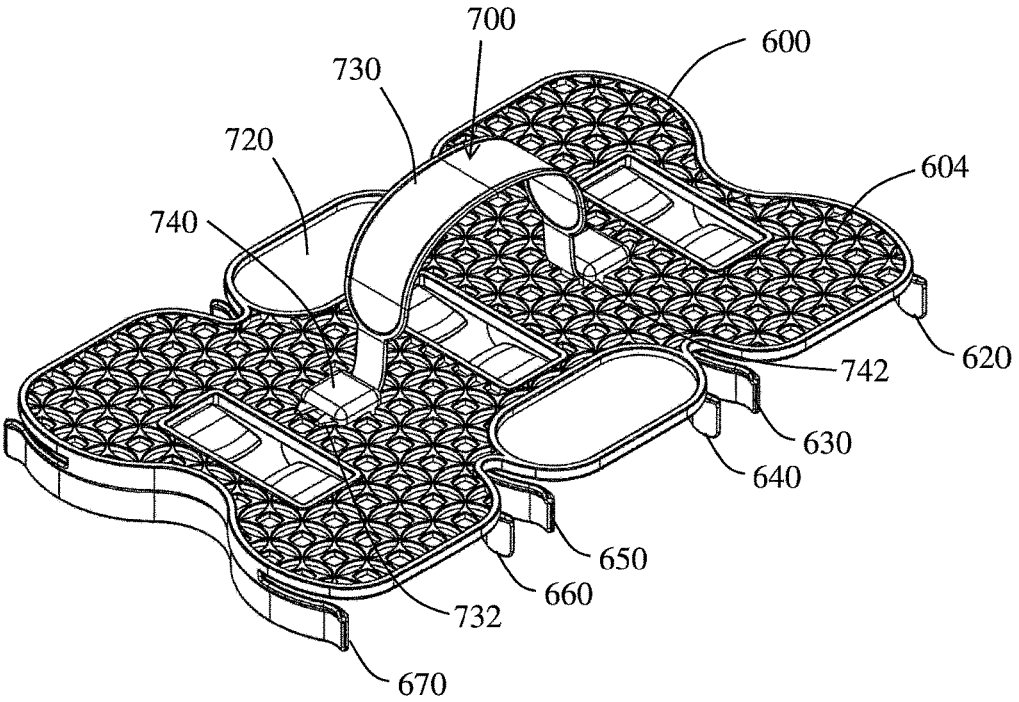
FIG. 9 is a top perspective view of the package carrying arrangement of FIG. 8.
Figure 11:
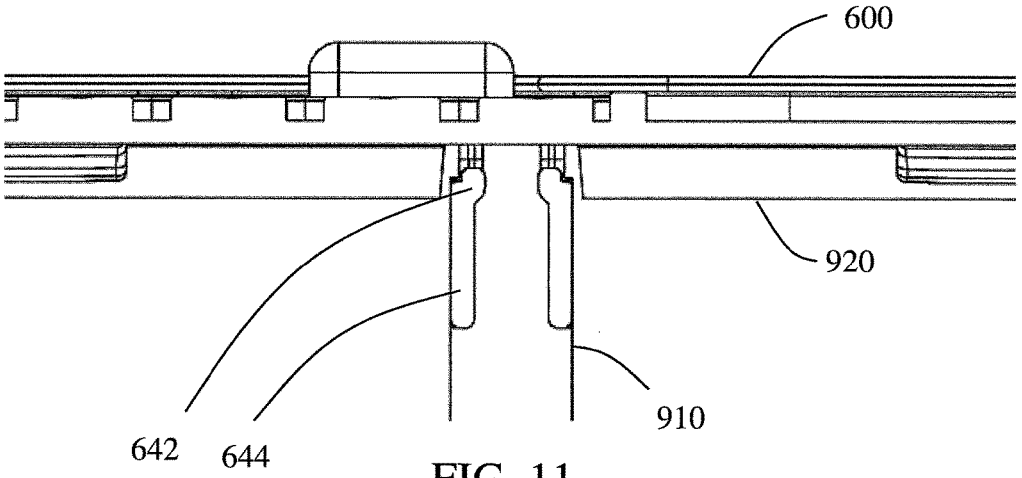

Referring now to FIGS. 9 and 11, the package carrying arrangement includes a handle portion 700 that is located at the bottom surface of the panel portion. The size and shape of the handle portion are non-limiting. The handle portion is illustrated as including two strap mounts 740 and a strap 730. The strap mounts are connected to the bottom surface of the panel portion and are spaced from one another. Generally, the strap mounts are positioned at an equal distance between the first and second longitudinal side edges; however, this is not required. Generally, the strap mounts are spaced inwardly from the outer edges of the panel portion; however, this is not required. The strap mounts each includes a slot 742 that allows a portion of the strap to move therein; however, this is not required. The ends of the strap include a stop 732 to prevent the ends from passing through slot 742; however, this is not required. As can be appreciated, other arrangements can be used to limit the movement of the strap in the strap mounts. The strap can be formed of a flexible material (e.g., flexible plastic, flexible cloth, flexible mesh, nylon, etc.); however, this is not required. The middle portion of the handle can includes a wider region that can be optionally padded; however, this is not required. FIG. 11 illustrates the strap in the stored position and FIG. 9 illustrates the strap in the use position. As such, the flexible strap can lie flat on the bottom surface of the panel portion when in the stored position and can be raised up for a user to grasp in the use position. After use, the strap can be repositioned in the stored position; however, this is not required. The handle portion can be configured to be detachable from the panel portion; however, this is not required. As can be appreciated, the carrying device 100 can be designed for use with two or more handles; however, this is not required. In such an arrangement, the carrying device would include a plurality of the structures discussed above to enable two or more handles to be simultaneously used on the carrying arrangement as described above with regard to the single handle arrangement. The handle portion allows a user to conveniently carry the package carrying arrangement.

The bottom surface of the panel portion can include one or more impressed zones 720 for the purpose of providing various types of information (e.g., a label, a sticker, etc.); however, this is not required. The bottom surface of the panel portion can optionally include a printed design, ribs that form a design, etc. The ribs and/or printed design (when used) can be configured to improve the structural integrity and/or rigidity of the panel portion; however, this is not required. As illustrated in FIG. 9 and FIG. 11, the bottom surface of the panel portion optionally includes a plurality of overlapping circular ribs of similar size and shape; however, other or additional structures can be used.

Figure 8:
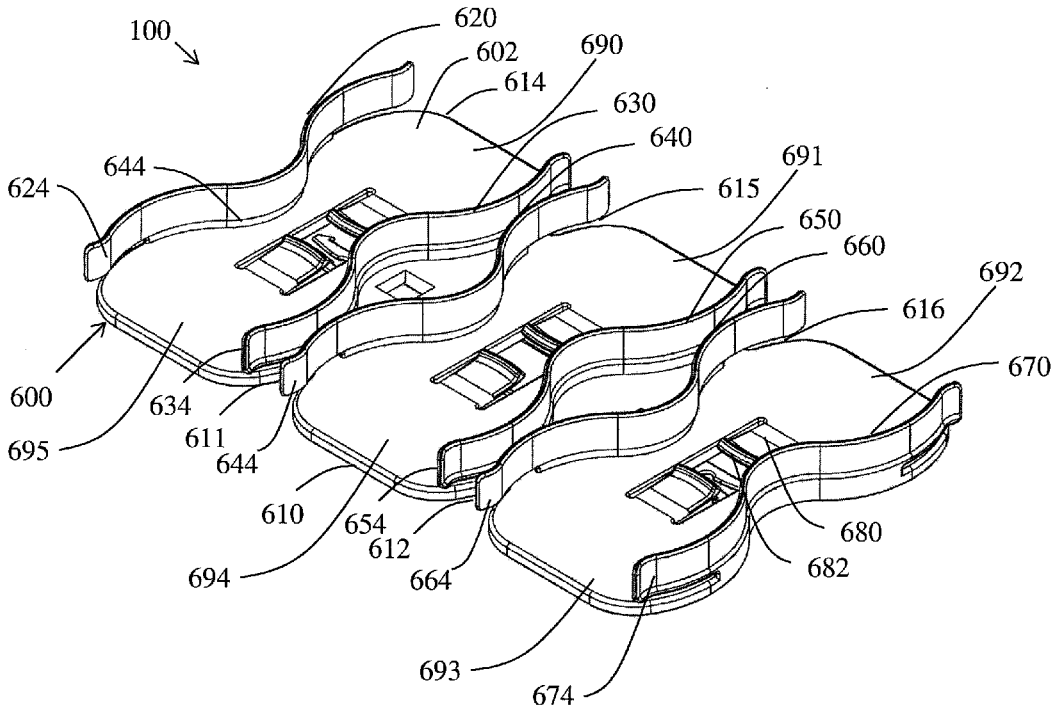
FIG. 8 is a perspective illustration of another non-limiting package carrying arrangement according to the present invention.

Provided on the top surface of the panel portion are a plurality of outwardly extending container flanges extending upwardly from the top surface. As illustrated in FIG. 8, the top surface 702 of the panel portion includes six container flanges 620, 630, 640, 650, 660, 670. Each of the container flanges can have an arcuate and/or wave shape in transverse cross-section; however, other or additional shapes can be used. For example, each of the container flanges can include a first arcuate portion, a second arcuate portion, and a transition portion positioned between the first and second arcuate portions that can also be arcuate. The first and second arcuate portions are configured to engage a portion of a container that is positioned on the panel portion. The transition portion, which can have a shape other than an arcuate shape, merely separates the first and second arcuate portions from one another. The radius of curvature of the first and second arcuate portions is generally the same. Generally, the radius of curvature is equal to or slightly larger or small (±10%) than the radius of the container that is to be inserted into the panel portion; however, this is not required. When the transition portion is arcuate, the radius of curvature of the transition portion can be the same or different from the radius of curvature of the first and second arcuate portions. In the non-limiting embodiment illustrated in FIG. 8, the inner surface of the container flanges contains no straight edges and is continuously curved along the longitudinal length of the container flange; however, this is not required. The container flanges can extend partially or completely from first longitudinal side edge 610 to second longitudinal side edge 614.

As illustrated in FIG. 8, container flanges 620 and 730 have side faces that face one another. One or more containers 900 are designed to be releasably retained between container flanges 620 and 630. Likewise, container flanges 640 and 650 have side faces that face one another. One or more containers 900 are designed to be releasably retained between container flanges 640 and 650. Also, container flanges 660 and 670 have side faces that face one another. One or more containers 900 are designed to be releasably retained between the container flanges 660, 670. The portions of the faces of the container flanges facing one another mirror one another; however, this is not required. As illustrated in FIG. 8, each pair of facing container flanges is configured to releasably connect up to two containers to the panel portion.

Container flanges 630 and 640 are illustrated as being spaced apart and not connected together. Likewise, the container flanges 650 and 660 are illustrated as being spaced apart and not connected together; however, this is not required. As can be appreciated, the container flanges can be optionally connected together. As illustrated in FIG. 8, indentations 611, 612, 615, 616 line up between two adjacently positioned connection flanges; however, this is not required. As illustrated in FIG. 8, an opening in the panel portion can exist between connected container flanges 630, 640 and/or connected container flanges 650, 660; however, this is not required.

Connected to each end of each of the container flanges is an optional flexible flange portion 624, 634, 644, 654, 664, 674; however, this is not required. All or a portion of the bottom of the flexible flange portion is spaced from the top surface of the panel portion. This spacing enables the flexible flange portion to flex outwardly from a container that is being inserted between or removed from two facing container flanges. The rear portion of the flexible flange portion is illustrated as being connected to the end of the container flanges. The rear portion of the flexible flange portion is illustrated as curving inwardly and having a radius of curvature that is generally the same or similar to the radius of curvature of the arcuate portion of the container flange that the flexible flange portion is connected to; however, this is not required. The front portion of the flexible flange portion is illustrated as curving outwardly; however, this is not required. The curvature of the front portion of the flexible flange portion facilitates in the insertion of the container between the flexible flange portions as the container is inserted between two container flanges; however, this is not required. The length of the front portion of the flexible flange portion can be equal to or less than the length of the rear portion of the flexible flange portion; however, this is not required. As illustrated in FIG. 8, the container flange and the flexible flange portion are at least partially integrally formed with one another; however, this is not required. The front end of the flexible flange is illustrated as extending to the side of the panel portion or beyond the panel portion; however, it can be appreciated that the front end of the flexible flange can be spaced inwardly of the side edge of the panel portion.

Referring now to FIGS. 8 and 11, the side face of each of the container flanges includes a retaining arrangement in the form of a retaining rib 644. The bottom portion 642 of the container flange extends upwardly (e.g., perpendicular to the surface, etc.) from the top or bottom surface of the panel portion. The retaining rib is illustrated as being spaced upwardly from the top or bottom surface of the panel portion. The bottom portion 643 of the retaining rib is illustrated as sloping outwardly from the side face of the container flange; however, this is not required. The upper portion 645 of the retaining rib has a side face that is illustrated as being parallel to the side face of the bottom portion of the container flange; however, this is not required. As can be appreciated, the configuration of the retaining rib can have other configurations.

Figure 10:
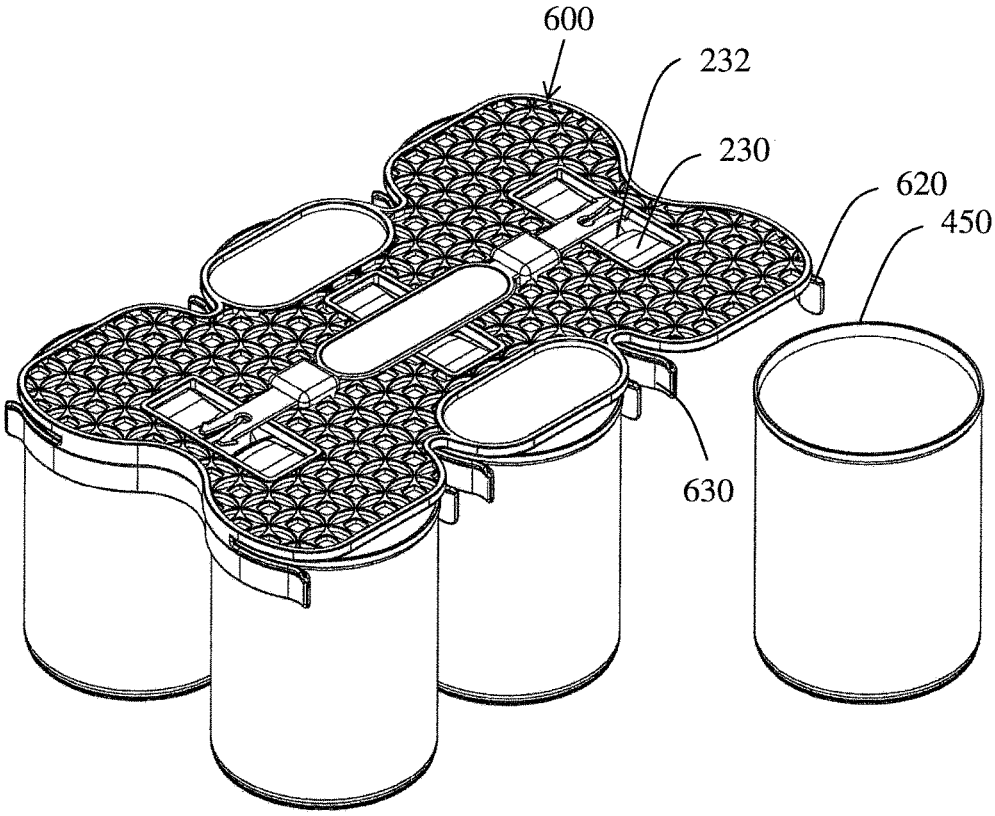
FIG. 10 is a perspective illustration of the package carrying arrangement of FIG. 9 that includes a plurality of containers loaded on the package carrying arrangement; and, FIG. 11 is an enlarged cross-sectional perspective illustration of the package carrying arrangement of FIG. 10 illustrating the arrangement for retaining containers on the package carrying arrangement.

As illustrated in FIG. 11, when a container 900 is inserted into the panel portion, the rim 920 of the container is positioned at least partially under the bottom portion 643 of the retaining rib, and is thus prevented by the retaining rib from moving upwardly past the retaining rib. The thickness of the retaining rib is selected to overlie at least a portion of rim 920, but still allow the body 910 of the container to extend upwardly and past the retaining rib as illustrated in FIG. 10. As illustrated in FIG. 11, the upper portion of the retaining rib is in contact with the body of the container when the container is releaseably connected by the container flanges to the panel portion; however, this is not required. As also illustrated in FIG. 11, the retaining rib is in contact with the rim of the container when the container is releaseably connected by the container flanges to the panel portion; however, this is not required.

Panel portion 600 can optionally include one or more position flanges 680. The position flanges are illustrated as being movable relative to the top or bottom surface of the panel portion; however, this is not required. The end of each of the position flanges includes a lip and/or hook 682; however, this is not required. The position flanges (when used) are configured to limit the distance a container can be slid between the container flanges. The lip 682 is configured to engage the rim and/or body of the container once the container has been slid a certain distance between the container flanges and thereafter inhibit or prevent the container from further being slid inwardly; however, this is not required. The position flange can optionally be biased in a position with an angle of from about 5-10° relative to the top or bottom surface of the panel portion; however, this is not required. As can be appreciated, the angle of the position flange can be less or greater than 5-10°. The biased position of the position flange can be used to facilitate in creating a friction engagement between the container and the position flange and/or the container and the retaining rib; however, this is not required. Such friction engagement can be used to improve the connection of the container to the package carrying arrangement and/or to limit the movement of the container when connected to the package carrying arrangement; however, this is not required.

Referring now to FIG. 10, up to six containers can be releasably connected to the top surface of the panel portion. As can be appreciated, the number of containers that can be releasably connected to the top surface of the panel portion is non-limiting.

In use, a container 900 (e.g., can, etc.) can be pushed into position on the panel portion with the lid 920 of the container facing the top or bottom surface of the panel portion. As the container is pushed into position, the flexible flange portions and the container flanges engage the container body and are caused to flex and separate from one another. As illustrated in FIG. 8, the package carrying arrangement includes a plurality of container cavities 690, 691, 692, 693, 694, 695 that are configured to each releasably secure a container to the panel portion. Each container cavity is configured to receive a container from the side of the package carrying arrangement. FIG. 10 illustrates five containers that have been releasable secured to the top surface of the panel portion and a sixth container that is positioned to be inserted into container cavity 690. During the securing process of the container into container cavity 690, the container is oriented such that the top of the container faces the top surface of panel portion 600. Thereafter, the container is moved toward second longitudinal side edge 614 to the front opening of container cavity 690. The container is continued to be moved into container cavity 690 such that the body of the container engages the front portion of flexible flange portion 624 of container flange 620 and flexible flange portion 634 of container flange 630. As the container is continued to be moved into container cavity 690, the flexible flange portions 624, 634 are caused to flex outwardly and away from one another such that the container can pass between the flexible flange portions. The smallest distance between the front portion of flexible flange portion 624 of container flange 620 and flexible flange portion 634 of container flange 630 is generally less than the diameter of the body of the container; however, this is not required. As the body of the container is moved past the front portion of flexible flange portions, container rim 920 at least partially passes under retaining rib 644 while the body of the container passes by the retaining rib 644. A portion of container flanges 620, 630 can be configured to at least partially flex or deform as the container passes between the two container flanges; however, this is not required. As the container is moved fully past the flexible flange portions, container flanges 420, 430 partially or fully flex back to their original positions. When the container is fully positioned in a container cavity, the container flange and the flexible flange portions generally encircle about 15-70% the outer perimeter of the container. When the container is to be removed from the package carrying arrangement, the container is pulled outwardly from the container cavity. As the container is pulled from the container cavity, at least a portion of one or both of the container flanges can optionally flex or deform to allow the middle of the container to pass between the two container flanges and out of the container cavity. As the body of the container moves past the flexible flange portions, flexible flange portions 624, 634 are caused to flex outwardly and away from one another such that the container can pass between the flexible flange portions. As the container is moved fully past the flexible flange portions, the flexible flange portions flex back to their original positions. The procedure above for inserting and removing containers on the package carrying arrangement can be repeated for each of the container cavities on the package carrying arrangement.

When the package carrying arrangement is partially or fully loaded with containers, the package carrying arrangement can be easily carried by the handle portion.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

What is claimed:

1. A portable package carrying arrangement comprising:

a panel portion, said panel portion having a top surface and a bottom surface, and first and second side edges, wherein at least one of said top and bottom surface includes a plurality of container retainers and a plurality of position flanges, each of said container retainers includes first and second container flanges, each of said container retainers configured to releasably secure a plurality of containers to said panel portion such that each of the containers are positioned adjacent to one another when connected by said container retainer, each of said first and second container flanges includes a retaining arrangement that is at least partially spaced above said top or bottom surface of said panel portion, said first and second container flanges are spaced apart from one another, said retaining arrangement on said first and second container flanges of each of said container retainers is configured to entrap at least a portion of the container between said retaining arrangements of said first and second container flanges and said top or bottom surface when the container is releasably secured to the panel portion, said first and second container flanges configured to encircle about 15-70% of a perimeter of each of the containers that are releasably connected to said panel portion, said first container flange configured to engage a plurality of containers that are releasably connected to said panel portion, each of said position flanges is connected to at least one of said top and bottom surfaces, each of said position flanges is configured to engage a body or rim of the container when the container is releasably connected to the panel portion, each of said position flanges is spaced from said plurality of said container retainers; and a handle portion, said handle portion connected to said panel portion, said handle portion configured to enable a user to grasp said handle portion and carry said panel portion, each of said position flanges is configured to be movable relative to said top or bottom surface of said panel portion, each of said position flanges is configured to be pushed downwardly when the container is releasably connected to the panel portion.

2. The portable package carrying arrangement as defined in claim 1, wherein said first and second container flanges each have a longitudinal length that extends between said first and second sides of said panel portion.

3. The portable package carrying arrangement as defined in claim 2, wherein said handle portion is at least partially connected to a top edge of said panel portion, a container flange, or a bottom surface of said panel portion.

4. The portable package carrying arrangement as defined in claim 3, including a base flange positioned at or near a bottom edge of said panel portion, said base flange configured to enable said panel portion to stand upright on said base flange.

5. The portable package carrying arrangement as defined in claim 3, wherein each of said position flanges is biased at an angle of 1-20° from said top or bottom surface of said panel portion.

6. A portable package carrying arrangement comprising:

a panel portion, said panel portion having a top surface and a bottom surface, first and second side edges, and upper and base edges, wherein at least one of said top and bottom surface includes a first and second container retainers, and a first position flange, each of said container retainers including first and second container flanges, each of said container flanges having an engagement surface configured to releasably engage and to secure a plurality of containers to said panel portion, said first and second container flanges spaced apart from one another and said engagement surface of said first and second container flanges facing one another, each of said first and second container flanges includes a retaining arrangement that is at least partially spaced above said top or bottom surface of said panel portion, said retaining arrangement on said first and second container flanges of each of said container retainers configured to entrap at least a portion of the container between said retaining arrangements of said first and second container flanges and said top or bottom surface when the container is releasably secured to the panel portion, said first and second container flanges configured to encircle about 15-70% of a perimeter of each of the containers that are releasably connected to said panel portion, said first position flange connected to at least one of said top and bottom surfaces, said first position flange configured to engage a body or rim of the container when the container is releasably connected to the panel portion, said first position flange positioned between and spaced from said first and second container flanges, said first position flange configured to be movable relative to said top or bottom surface of said panel portion, said first position flange configured to be pushed downwardly when the container is releasably connected to the panel portion; and a handle portion, said handle portion connected to said panel portion, said handle portion configured to enable a user to grasp said handle portion and carry said panel portion.

7. The portable package carrying arrangement as defined in claim 6, including a second position flange, said second position flange is connected to at least one of said top and bottom surfaces, said second position flange is configured to engage a body or rim of the container when the container is releasably connected to the panel portion, said second position flange is positioned between and spaced from said first and second container flanges, said second position flange is spaced from said first position flange, said second position flange is configured to be movable relative to said top or bottom surface of said panel portion, said second position flange is configured to be pushed downwardly when the container is releasably connected to the panel portion.

8. The portable package carrying arrangement as defined in claim 6, wherein said second container flange of said first container retainer is connected to said first container flange of said second container retainer.

9. The portable package carrying arrangement as defined in claim 7, wherein a second container flange of said first container retainer is connected to said first container flange of said second container retainer.

10. The portable package carrying arrangement as defined in claim 6, wherein said first and second container flanges have a wave shape.

11. The portable package carrying arrangement as defined in claim 9, wherein said first and second container flanges have a wave shape.

12. The portable package carrying arrangement as defined in claim 6, wherein said handle is connected to said upper edge and to said first container flange of said first container retainer.

13. The portable package carrying arrangement as defined in claim 11, wherein said handle is connected to said upper edge and to said first container flange of said first container retainer.

14. The portable package carrying arrangement as defined in claim 6, including a base flange positioned at or near said base edge of said panel portion, said base flange configured to enable said panel portion to stand upright on said base flange, said base flange connected to one of said container flanges.

15. The portable package carrying arrangement as defined in claim 13, including a base flange positioned at or near said base edge of said panel portion, said base flange configured to enable said panel portion to stand upright on said base flange, said base flange connected to one of said container flanges.

* * * * *